US007030816B2

(12) United States Patent
Dai et al.

(10) Patent No.: US 7,030,816 B2
(45) Date of Patent: Apr. 18, 2006

(54) PRINTED PIFA ANTENNA AND METHOD OF MAKING THE SAME

(75) Inventors: Hsin Kuo Dai, Tu-Chen (TW); Lung-Sheng Tai, Tu-Chen (TW); Hsien-Chu Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/943,427

(22) Filed: Sep. 16, 2004

(65) Prior Publication Data

US 2005/0062651 A1 Mar. 24, 2005

(30) Foreign Application Priority Data

Sep. 19, 2003 (TW) ..... 92125990 A

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/846, 830

See application file for complete search history.

(56) References Cited

U.S. PATENT DOCUMENTS

| | | | | |
|---|---|---|---|---|
| 6,118,406 | A * | 9/2000 | Josypenko | 343/700 MS |
| 6,198,439 | B1 * | 3/2001 | Dufrane et al. | 343/700 MS |
| 6,348,892 | B1 * | 2/2002 | Annamaa et al. | 343/700 MS |
| 6,556,169 | B1 * | 4/2003 | Fukuura et al. | 343/700 MS |
| 6,563,463 | B1 * | 5/2003 | Saito | 343/700 MS |
| 2002/0030628 | A1 * | 3/2002 | Tsai | 343/702 |

* cited by examiner

*Primary Examiner*—Hoang V. Nguyen
*Assistant Examiner*—Angela M Lie
(74) *Attorney, Agent, or Firm*—Wei Te Chung

(57) ABSTRACT

A printed PIFA antenna (1) for an electronic device includes a multi-layer substrate, a U-shaped radiating element or rectangular-wave shaped radiating element disposed in the substrate, a ground portion disposed on surfaces of the substrate and a feeder cable including an inner conductor connecting with radiating element and an outer conductor connecting with ground portion. A multi-layer printed technology is introduced into a design of a PIFA antenna, which will achieve a very compact antenna structure.

14 Claims, 5 Drawing Sheets

Socale: 5dBi/div
Operating Frequency: 2.45GHz
Horizontally polarized

Socale: 5dBi/div
Operating Frequency: 2.45GHz
Vertically polarized

PRINTED PIFA ANTENNA AND METHOD OF MAKING THE SAME

BACKGROUND OF THE INVENTION

1. Field of the Invention

The present invention relates to an antenna, and in particular to a planar Inverted-F antenna (PIFA) employed in an electronic device and a method of making the same.

2. Description of the Prior Art or Related Art

Microstrip antennas can be applied as built-in antennas for many kinds of portable electronic devices for their small and compact structure. The resonant frequency of a traditional microstrip antenna usually is determined by the size of antenna's radiating element. Typically the length of the radiating element is a half of the radiating wavelength of the operating frequency.

For portable application, specially as a built-in antenna, a planar Inverted-F antenna (PIFA), especially a printed PIFA antenna is more preferred design to get smaller antenna for its operation length only being ¼ to the wavelength of the operating frequency. Specially, inserting a dielectric substrate with a high dielectric constant between the radiating element and ground portion will get a shorter operating length of the antenna (i.e. less than 1/10 wavelength of operating frequency). When operating frequency and dielectric substrate are determined, the length of the radiating element is substantially decided. To fully utilize the space of a portable device, the radiating element can be curved in one or more surface of the dielectric substrate. For example, the radiating element a traditional printed PIFA is typically a straight trace. The antenna will become shorter when a U-shaped (or other spiral shape) radiating element is introduced rather than a straight one.

U.S. Pat. No. 6,535,443 discloses a printed PIFA antenna with a spiral-radiating element. This PIFA antenna comprises a printed circuit board (PCB) 310, a dielectric substrate 320 disposed on a PCB 310 and a spiral metal strip 315 acting as a radiating element printed on a top surface the substrate 320. A matching bridge 330 shorts the strip 315 to the PCB 310. The antenna feed pin 325 disposed on the side surface connects with the strip 315.

However, the spiral metal strip is only disposed one of the surfaces of the substrate. The inner space of the substrate is not used. If the inner space is used to receive the printed radiating element the antenna structure will be more compact.

Hence, an improved antenna assembly is desired to overcome the above-mentioned disadvantages of the prior and related arts.

BRIEF SUMMARY OF THE INVENTION

A primary object of the present invention is to provide a printed planar Inverted-F antenna (PIFA) having a compact structure while having a good antenna performance.

A printed PIFA antenna comprises a multi-layer substrate including a first and second substrates stacked in thickness direction, a first and second radiating traces respectively disposed on upper surfaces of said first and second substrates, a connecting trace for connecting said first and second radiating traces to form a radiating element for the printed PIFA antenna, a ground portion disposed at least on the upper surface of the first substrate, a shorting trace for shorting said radiating element to the ground portion, and a feeder cable comprising an inner conductor electrically connecting with the radiating element and an outer shield conductor electrically connecting with the ground portion.

another object of this present invention is to provide a method of making the printed PIFA antenna for an electronic device. The method mainly comprise following steps: a. choosing a multi-layer dielectric substrate which is smaller than the left space of the electronic device; b. calculating the length of a radiating element according to the operating frequency and dielectric constant and curving the radiating element to a predetermined shape according to the left space of the electronic device; c. disposing a ground portion on a surface substrate and disposing the radiating element on the printed route; d. calculating the length and shape of a shorting trace for shorting the radiating element to the ground portion; e. making a printed route according to the shape of the radiating element and the shape of the shorting trace; f. providing a feeder line which comprises an inner conductor and an outer conductor and respectively electrically connecting the inner conductor with radiating element and the ground portion.

Still another objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
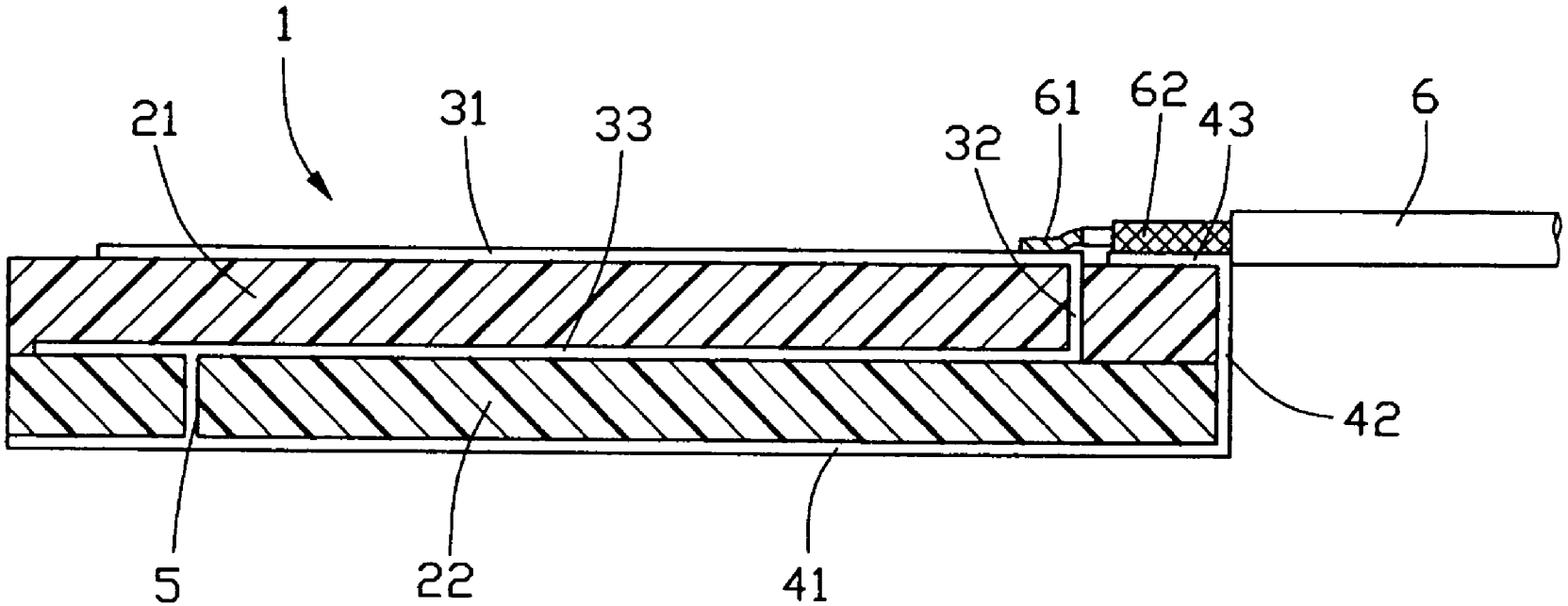
FIG. 1 is a cross sectional side view of a printed planar Inverted-F antenna (PIFA) in accordance with a preferred embodiment of the present invention.
Figure 2:
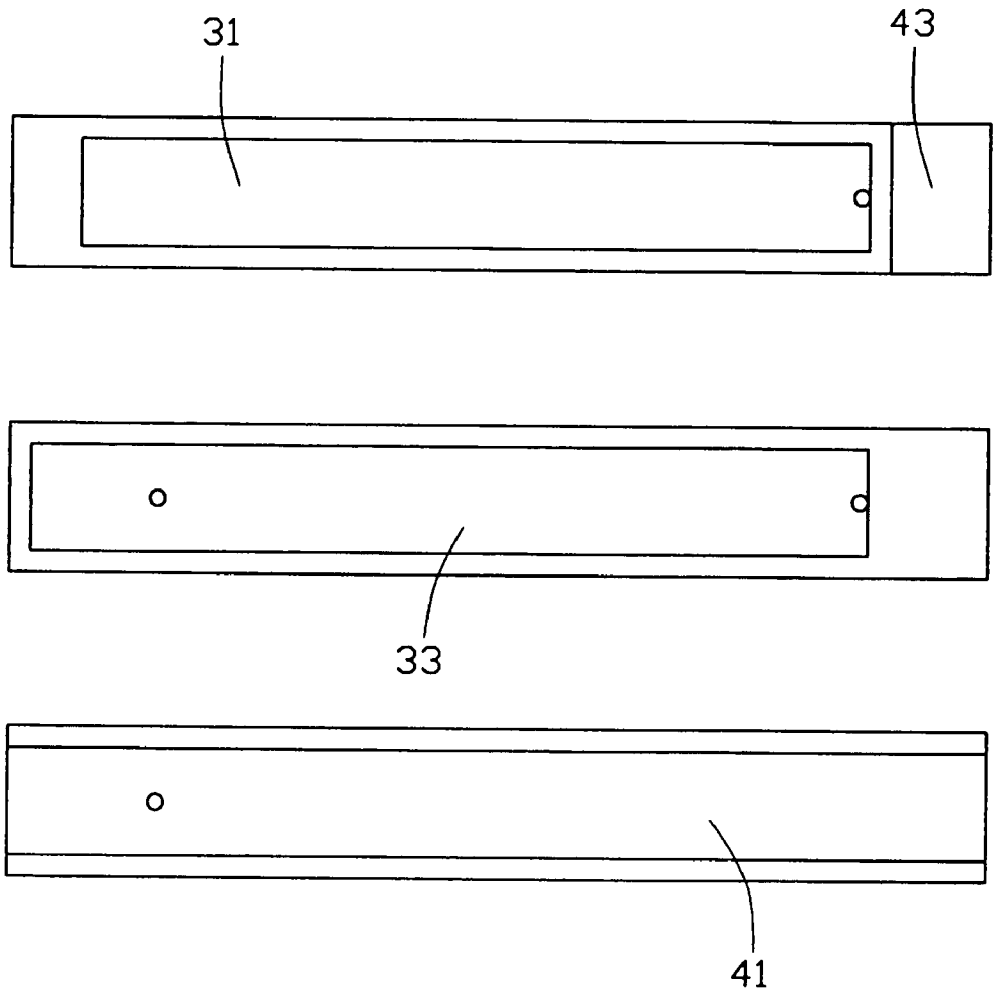
FIG. 2 illustrates the printed trace each layer of the multi-layer substrate of the printed PIFA antenna of FIG. 1.
Figure 3:
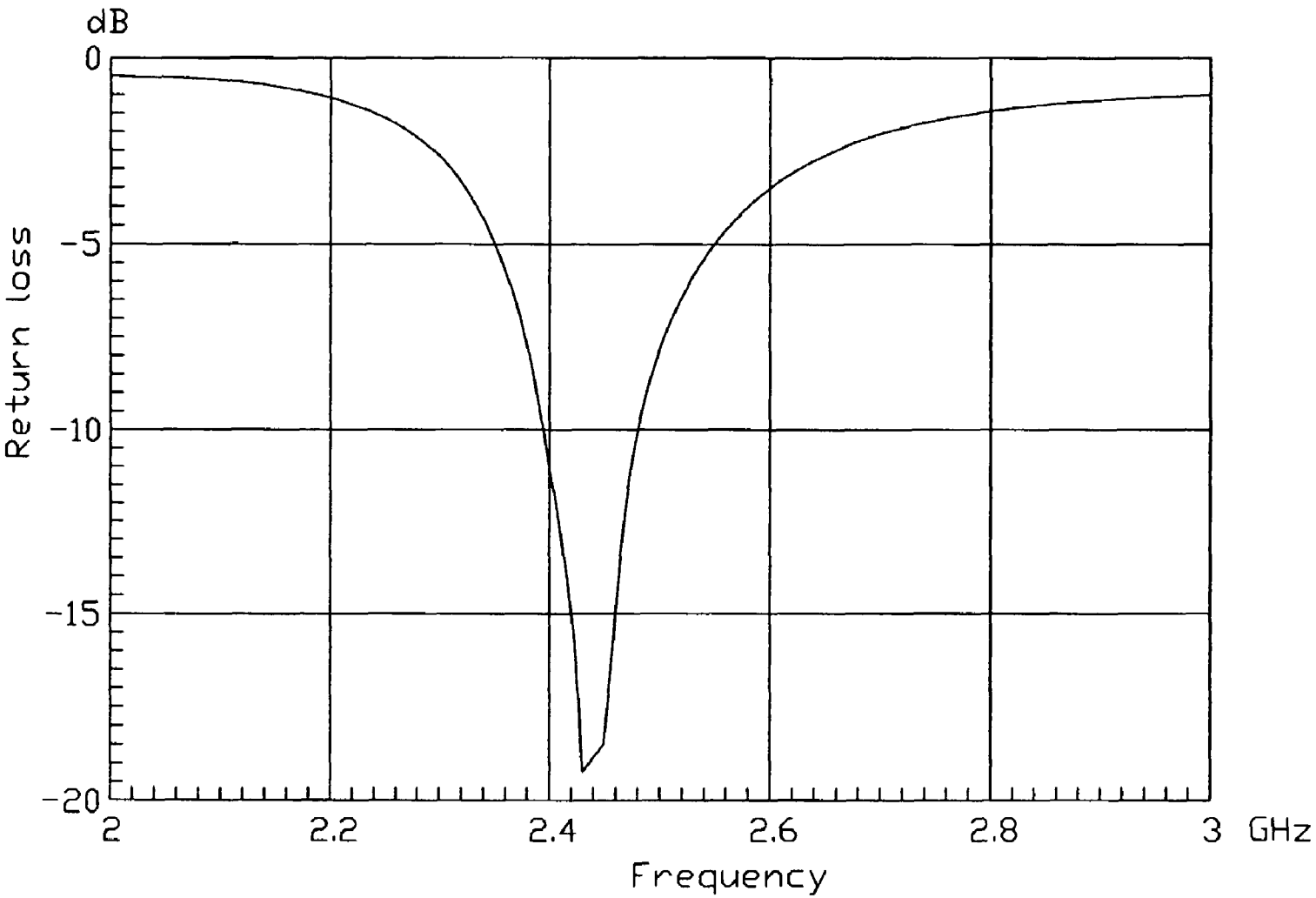
FIG. 3 is test chart recording for the printed PIFA antenna of FIG. 1, showing Voltage Standing Wave Ratio (VSWR) as a function of frequency.
Figure 4:
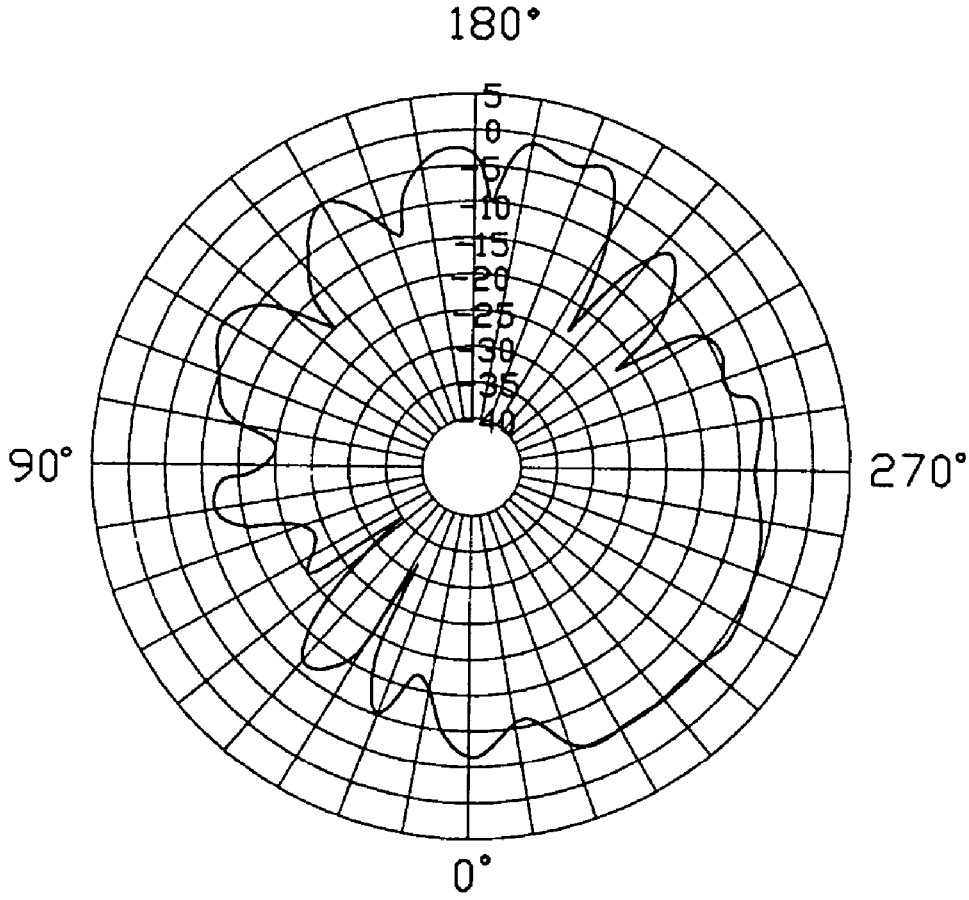
FIG. 4 is a recording of a horizontally polarized principle plane radiation pattern of the multi-band printed dipole antenna of FIG. 1 operating at a frequency of 2.45 GHz.
Figure 5:
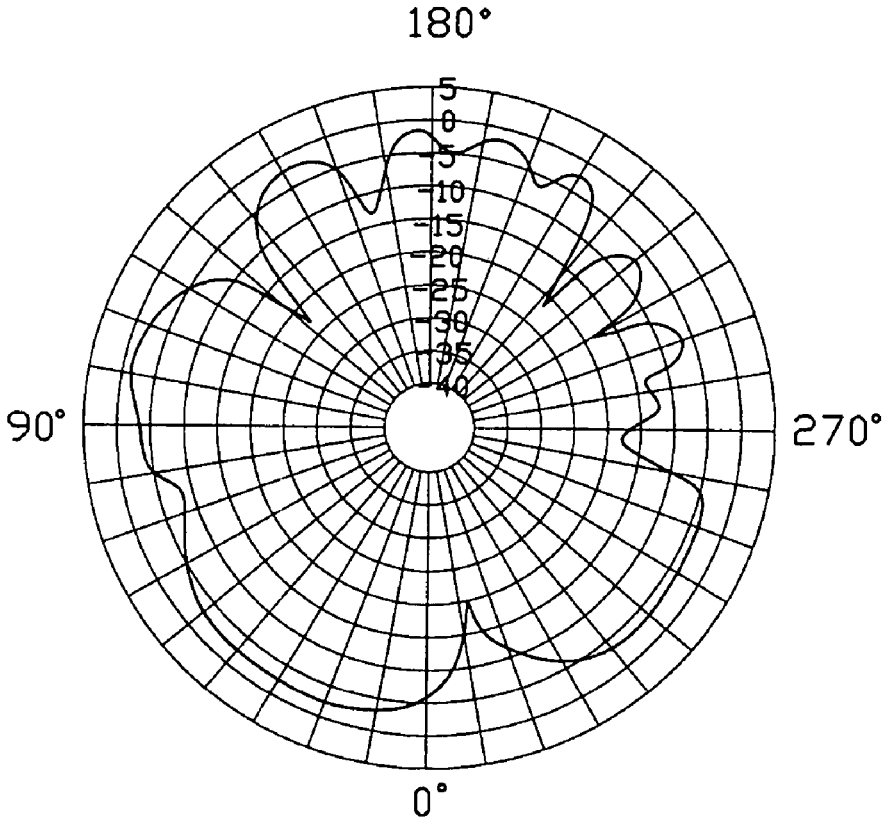
FIG. 5 is a recording of a vertically polarized principle plane radiation pattern of the multi-band printed dipole antenna of FIG. 1 operating at a frequency of 2.45 GHz.

Referring to FIG. 1 and FIG. 2, a printed planar Inverted-F antenna (PIFA) 1 in accordance with a proffered embodiment of the present invention comprises a multi-layer substrate which includes a first and second rectangular dielectric substrates 21, 22, a substantially U-shaped radiating element, a short trace 5, a ground portion and a coaxial cable 6.

The first and second substrates 21, 22 are in the same dimension but in different material and are stacked in a vertical direction. The U-shaped radiating element includes a first radiating trace 31 disposed on a top surface of the first substrate 21, a second radiating trace 33 disposed on an upper surface of the second substrate 22 and a printed connecting trace 32. The first and second radiating traces 31, 33 are both little shorter than the length of the first substrate 21 and their width is also little narrower than that of the first substrate 21, which will achieve a compact antenna structure. The right ends of the first and second radiating traces 31, 33 defines a line perpendicular to the first and second radiating traces 31, 33. A first hole is defined through the first substrate 21 along said line. The printed connecting trace 32 is disposed in the first hole for connecting the right ends of the first and second radiating traces 31, 33.

The ground portion includes a lower ground trace 41, an upper ground trace 43 and a side ground trace 42. The lower ground trace 41 substantially covers a lower surface of the second substrate 22. The upper ground trace 43 is disposed on the right portion of the top surface of the first substrate 21. A left end of the upper ground trace 43 is close to the right end of the first radiating trace 31. A right end of the upper ground trace 43 electrically connects with the lower ground trace 41 via the side ground trace 42 which extends along right side surface of the first and second substrates 21, 22.

A second hole is defined through the second substrate 22 on the left portion of the second substrate 22. A shorting trace 5 is disposed on the second hole for connecting the second radiating trace 33 with the lower ground trace 41.

The front portion of the feeder cable 6 is arranged on the upper ground of the first substrate 21. The feeder cable 6 is a coaxial cable comprising an inner conductor 61, an inner dielectric layer, an outer shielding conductor 62 and an outer dielectric layer. The inner conductor 61 and the outer shielding conductor 62 respectively electrically connect with the first radiating trace 31 and the upper ground trace 43 for supply power to said printed PIFA antenna 1.

The first and second substrate 21, 22 can be also made in same material or made in different dimension. The dielectric constant of the first and second substrate 21, 22 will determine the length of the U-shaped radiating element. Fox example, choosing higher dielectric constant results shorter length of the U-shaped radiating element. Thus in some case, the radiating element can be other shape.

The connecting trace 32, the second radiating trace 33 and the shorting trace 5 are used to provide impedance match between the printed PIFA antenna 1 and the feeder cable 6.

In other embodiments, three or more layer dielectric substrates can be used due to special applications. In these embodiments, the radiating element will be changed to other shape, such as rectangular-wave shape.

The present invention also provides a method of making said printed PIFA antenna 1. The length and shape of the radiating element can be chosen and calculated according to a receiving space of a portable electronic device (not shown) for received the printed PIFA antenna 1. For example, if the receiving space of the portable electronic device is very small, maybe more than two substrates are needed and hence a rectangular or other spiral shaped radiating element is preferred. But if the left space is fairly large maybe two substrates are satisfied enough and thus a U-shaped radiating element is chosen. The next step is to dispose the ground portion on the surfaces of the first and second substrates 21, 22. The following step is to choose a feed point and form the shorting trace 5 for shorting the second radiating trace 33 to the lower ground plane 41 according to impedance match request while a height of the U-shaped radiating element to the lower ground trace 41 should be also considered at the same time due to the desire bandwidth. For instance, the height is usually 3 mm in 802.11 applications. The next step is to dispose the shorting trace 5, radiating element and the ground portion on the printed routes. The final step is to electrically connect the inner conductor 61 of the feeder cable 6 with radiating element and connect the outer conductor 62 with the ground portion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A printed PIFA antenna comprising:

a first and second substrates stacked in thickness direction;

a radiating element comprising a first and second radiating traces respectively disposed on upper surfaces of said first and second substrates;

a connecting trace for connecting said first and second radiating traces;

a part of a ground portion disposed on the upper surface of the first substrate;

a shorting trace for shorting said radiating element to the ground portion; and a feeder cable comprising an inner conductor electrically connecting with the radiating element and an outer shield conductor electrically connecting with the ground portion.

2. The printed PIFA antenna as claimed in claim 1, wherein the radiating element is a substantially U-shaped printed trace.

3. The printed PIFA antenna as claimed in claim 1, wherein the ground portion extends along the upper surface of the first substrate, side surfaces of the first and second substrates and a lower surface of the second substrates.

4. The printed PIFA antenna as claimed in claim 1, further comprising a first and second holes, in which the connecting trace and the shorting trace are respectively disposed.

5. A printed PIFA antenna for an electronic device, comprising:

a multi-layer dielectric substrate;

a radiating element being disposed on at least two layers of the substrate;

a ground portion disposed on at least one surface of the substrate;

a shorting trace disposed through one layer of the substrate for shorting the radiating element to the ground portion; and a feeder cable comprising an inner conductor electrically connecting with the radiating element and an outer conductor electrically connecting with the ground portion.

6. The printed PIFA antenna as claimed in claim 5, wherein the radiating element is rectangular-wave shaped printed trace.

7. The printed PIFA antenna as claimed in claim 5, further comprising at least one hole through at least one layer.

8. The method of making a printed PIFA antenna for an electronic device comprising the steps of:

a. choosing a multi-layer dielectric substrate;

b. determining the length of a radiating element according to predetermined operating frequency and dielectric constant, curving the radiating element to a predetermined shape according to the determined length of theradiating element and then disposing the radiating element on each layer of the substrate;

c. disposing a ground portion on a surface of the substrate and disposing the radiating element on the layers of the substrate;

d. providing a shorting trace for shorting the radiating element to the ground portion;

f. providing a feeder line which comprises an inner conductor and an outer conductor and respectively electrically connecting the inner conductor with radiating element and the outer conductor with the ground portion.

9. The method of making a printed PIFA antenna as claimed in claim 8, wherein the radiating element is rectangular-wave shaped printed trace.

10. The method of making a printed PIFA antenna as claimed in claim 9, wherein the ground portion extends along a lower surface, a side surface and an upper surface of the substrate.

11. The method of making a printed PIFA antenna as claimed in claim 10, wherein the feeder cable is a coaxial cable comprising the inner conductor electrically connecting with a part of radiating element disposed on the upper surface of the substrate and an outer conductor electrically connecting with a part of the ground portion disposed on the upper surface of the substrate.

12. A printed PIFA antenna comprising:

a multi-layer dielectric substrate defining upper, middle and lower levels vertically;

a radiation trace and a ground trace located at the upper level;

another radiation trace located at the middle level;

another ground trace located at the lower level;

a side ground trace disposed between the upper and lower levels and connecting the ground trace to the another ground trace;

a connection trace disposed between the upper and the middle level and connecting the radiation trace to said another radiation trace;

a short trace disposed between the middle level and the lower level and connecting said another radiation trace to said another ground trace; and a feeder cable having inner conductor connected to the radiation trace and an outer conductor connected to the ground trace.

13. The antenna as claimed in claim 12, wherein the connection trace and the short trace are located at two opposite end areas of the substrate in a lengthwise direction thereof.

14. The antenna as claimed in claim 12, where said another ground trace extends longer than all other traces in a lengthwise direction of the substrate.

* * * * *